US005960650A

United States Patent [19]

Chi-Lung

[11] Patent Number: 5,960,650

[45] Date of Patent: Oct. 5, 1999

[54] DYEING MACHINE WITH CLOTH CONVEYER MEANS

[76] Inventor: Chang Chi-Lung, P.O. Box 82-144, Taipei, Taiwan

[21] Appl. No.: 08/982,269

[22] Filed: Dec. 1, 1997

[51] Int. Cl.[6] ..... D06B 3/28

[52] U.S. Cl. ..... 68/177; 68/184; 68/178

[58] Field of Search ..... 68/62, 177, 178, 68/181, 184

[56] References Cited

U.S. PATENT DOCUMENTS

| | | | |
|---|---|---|---|
| 2,494,731 | 1/1950 | Vincent et al. | 68/177 |
| 3,242,702 | 3/1966 | Fleissner | 68/177 |
| 4,015,452 | 4/1977 | Kreitz | 68/177 |
| 4,716,744 | 1/1988 | Turner et al. | 68/178 |

FOREIGN PATENT DOCUMENTS

| | | | |
|---|---|---|---|
| 1411323 | 8/1965 | France | 68/177 |
| 2161171 | 6/1973 | Germany | 68/177 |
| 2439747 | 3/1976 | Germany | 68/177 |
| 2559351 | 1/1977 | Germany | 68/177 |
| 2718823 | 11/1978 | Germany | 68/177 |
| 3813307 | 12/1988 | Germany | 68/177 |
| 261159 | 3/1990 | Japan | 68/177 |
| 1077525 | 8/1967 | United Kingdom | 68/177 |

*Primary Examiner*—Frankie L. Stinson
*Attorney, Agent, or Firm*—A & J

[57] ABSTRACT

A dyeing machine including a receiving chamber, a cloth passage disposed in combination with the receiving chamber through which a piece of cloth is inserted and dyed, a jet nozzle suspended above a front end of the cloth passage and controlled to spray a dyeing solution for coloring the inserted piece of cloth, and a cloth guide roller suspended above the jet nozzle and turned to guide the inserted piece of cloth from the front end of the cloth passage through the jet nozzle toward a rear end of the cloth passage, wherein a motor-driven cloth conveyer is mounted within the receiving chamber at a bottom side and controlled to deliver the inserted piece of cloth through the cloth passage; two cloth guide means are mounted inside the receiving chamber adjacent to two opposite ends of the motor-driven cloth conveyer for guiding the inserted piece of cloth from the front end of the cloth passage to the cloth conveyer and from the cloth conveyer to the rear end of the cloth passage, and detector means adapted to cut off power supply from the motor-driven cloth conveyer when the inserted piece of cloth is jammed.

2 Claims, 3 Drawing Sheets

DYEING MACHINE WITH CLOTH CONVEYER MEANS

BACKGROUND OF THE INVENTION

The present invention relates to dyeing machines, and more particularly to such a dyeing machine which comprises a conveyer and a set of cloth guide rollers for delivering cloth through a cloth passage for dying.

According to regular dyeing machines, the inserted piece of cloth is carried through a receiving chamber by the flowing force of provided dyeing solution and the gravity of the inserted piece of cloth. Because the piece of cloth to be dyed is carried forwards by dyeing solution, much dyeing solution must be provided. When much dyeing solution is provided, much waste water will be produced. When the inserted piece of cloth is circulated through the receiving chamber, it may easily be forced to angle. When dyeing different cloth, the flow rate must be properly controlled so that inserted cloth can be smoothly delivered through the receiving chamber. However, it is not easy to control the flow rate subject to the nature of the cloth to be dyed. When a thick piece of cloth is put in the dyeing machine, it cannot be moved forwards smoothly. Further, when the inserted piece of cloth is moved in the receiving chamber, it may be forced to rub against the inside wall of the receiving chamber, causing the fabric structure to be damaged.

SUMMARY OF THE INVENTION

The present invention has been accomplished to provide a dyeing machine which eliminates the aforesaid problems. According to one aspect of the present invention, the dyeing machine comprises a receiving chamber, a cloth passage disposed in combination with the receiving chamber through which a piece of cloth is inserted and dyed, a jet nozzle suspended above a front end of the cloth passage and controlled to spray a dyeing solution for coloring the inserted piece of cloth, and a cloth guide roller suspended above the jet nozzle and turned to guide the inserted piece of cloth from the front end of the cloth passage through the jet nozzle toward a rear end of the cloth passage, wherein a motor-driven cloth conveyer is mounted within the receiving chamber at a bottom side and controlled to deliver the inserted piece of cloth through the cloth passage; a detector is mounted inside the receiving chamber to detect the movement of the inserted piece of cloth, and to cut off power supply from the motor-driven cloth conveyer when the inserted piece of cloth is jammed. According to another aspect of the present invention, two cloth guide means are mounted inside the receiving chamber adjacent to two opposite ends of the motor-driven cloth conveyer for guiding the inserted piece of cloth from the front end of the cloth passage to the cloth conveyer and from the cloth conveyer to the rear end of the cloth passage. According to still another aspect of the present invention, the cloth guide means can be cloth guide plates, or auxiliary belt conveyers.

DETAILED DESCRIPTION OF THE PREFERRED EMBODIMENT

Figure 1:
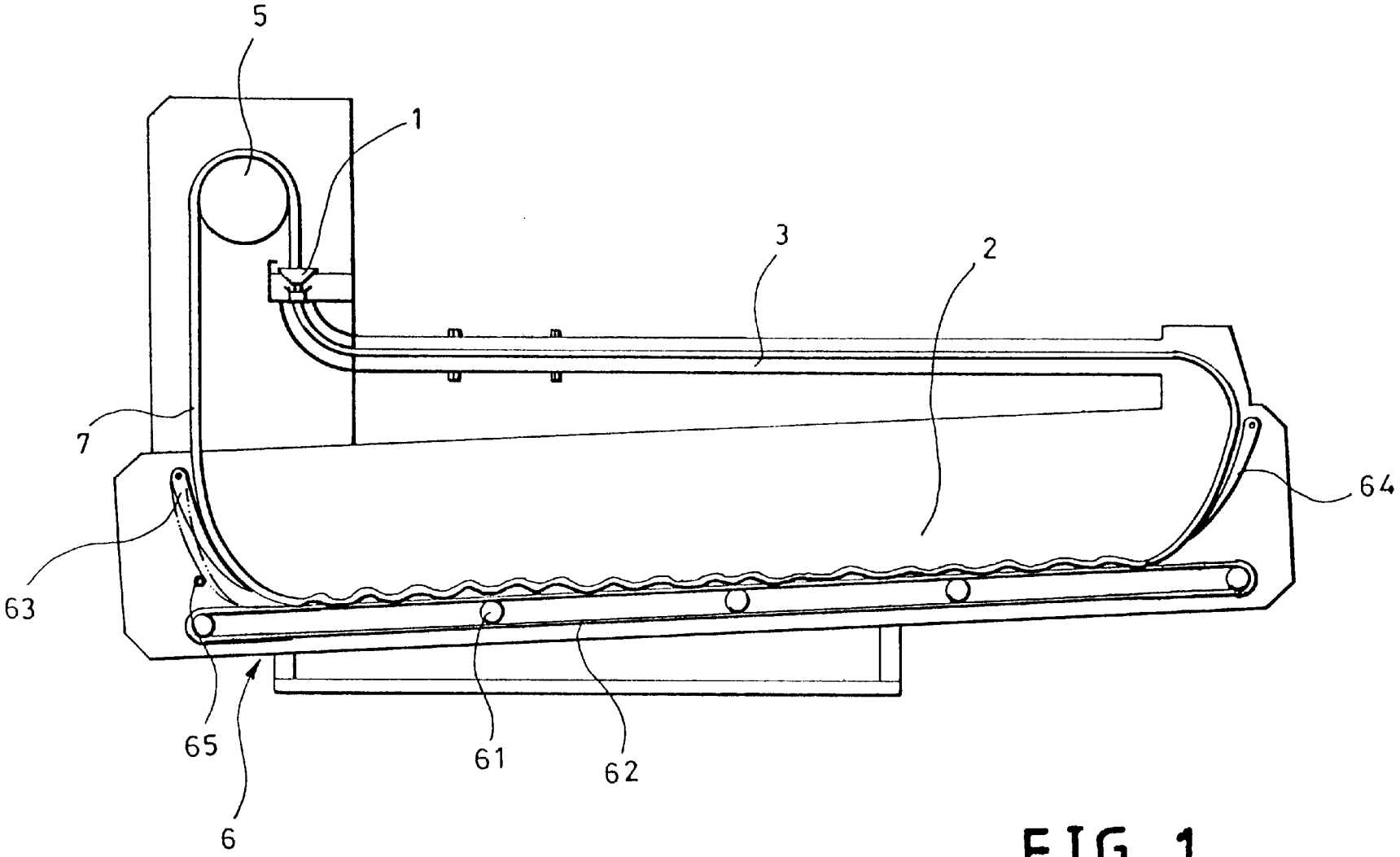
FIG. 1 is a side plain view of a dyeing machine according to the present invention.

Referring to FIG. 1, a dyeing machine in accordance with the present invention is generally comprises a cylindrical receiving chamber 2, a cloth passage 3, a jet nozzle 1 suspended on the inside at the top, and a cloth guide roller 5 disposed in front of the jet nozzle 13. When a piece of cloth 7 is inserted into the dyeing machine, it is circulated through the cloth passage 3 and dyed.

Referring to FIG. 1 again, a cloth conveyer 6 is mounted inside the receiving chamber 2 at the bottom, and controlled to deliver the inserted piece of cloth 7. The cloth conveyer 6 comprises a set of rollers 61, a conveying belt 62 mounted around the rollers 61, and a motor drive (not shown) driven to turn the rollers 61. When the rollers 61 are rotated by the motor drive, the conveying belt 62 is turned to deliver the piece of cloth 7. A fixed front cloth guide plate 63 and a movable rear cloth guide plate 64 are installed in the receiving chamber 2 near two opposite ends of the cloth conveyer 6. The front cloth guide plate 63 is fixedly fastened to the inside wall of the dyeing machine. The rear cloth guide plate 64 is pivoted to the inside wall of the dyeing machine. The front cloth guide plate 63 is adapted to guide the inserted piece of cloth 7 from the cloth passage 3 to the conveying belt 62. The rear cloth guide plate 64 is adapted to guide the inserted piece of cloth 7 away from the conveying belt 62 to the cloth passage 3. Further, a detector 65 is mounted inside the dyeing machine adjacent the fixed front cloth guide plate 63. If the inserted piece of cloth 7 is wrinkled and gathered together at the rear cloth guide plate 64 and unable to be delivered smoothly forwards, the rear cloth guide plate 64 will be forced by the inserted piece of cloth 7 to tilt to a certain angle. When the rear cloth guide plate 64 tilts over a predetermined angle, the detector 65 is immediately triggered to cut off power supply from the motor drive of the cloth conveyer 6, permitting the wrinkled cloth section of the inserted piece of cloth 7 to be delivered forwards by the cloth guide roller 5. As soon as the inserted piece of cloth 7 is pulled straight, the rear cloth guide plate 64 immediately returns to its former position, and the detector 65 is triggered again to turn on the motor drive of the cloth conveyer 6, for permitting the inserted piece of the cloth 7 to be smoothly delivered through the cloth passage 3.

Figure 2:
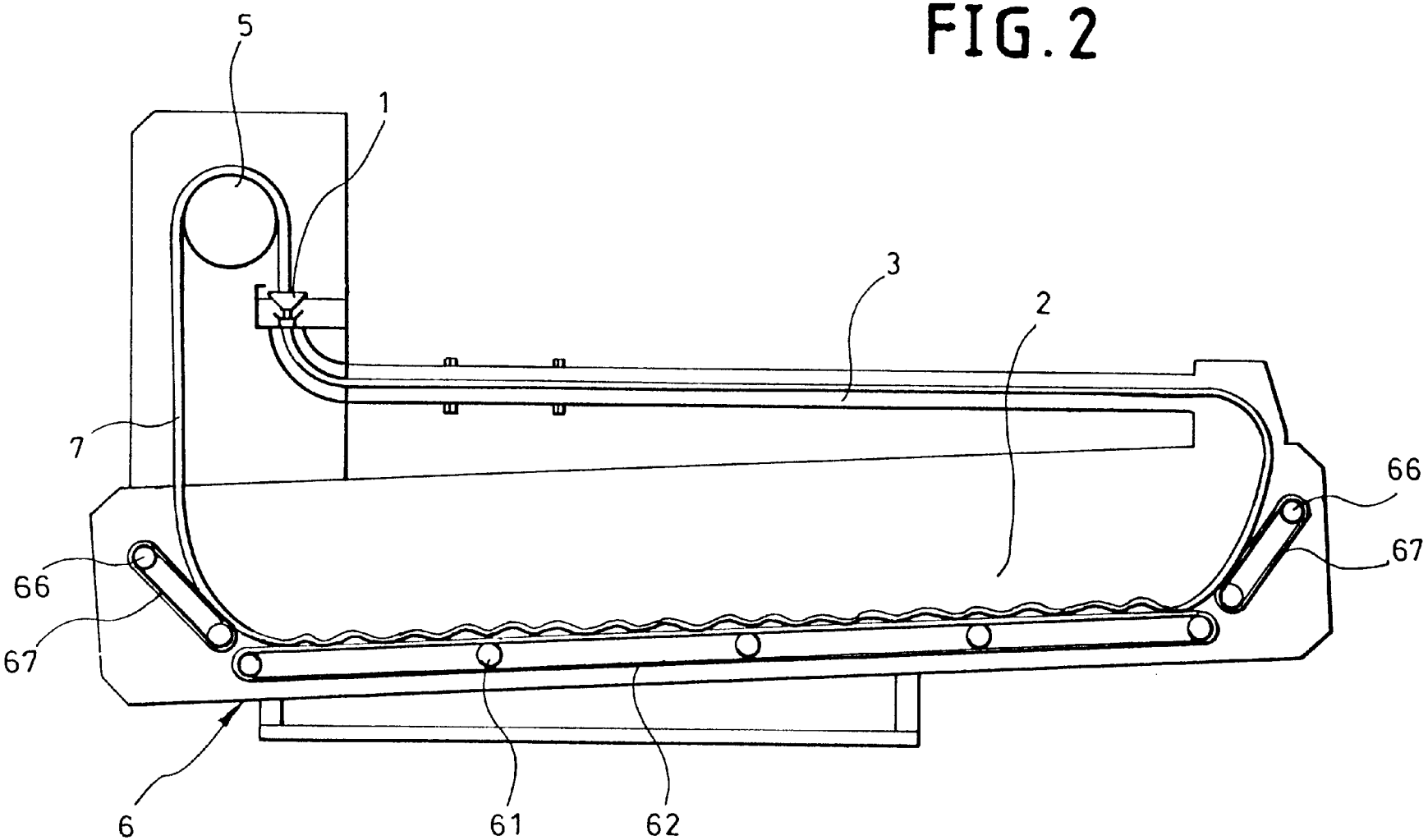
FIG. 2 is a side plain view of an alternate form of the present invention.

FIG. 2 shows an alternate form of the present invention, in which two cloth guide assemblies 62 are mounted inside the receiving chamber 2 and obliquely aimed at two opposite ends of the cloth conveyer 6, and adapted to guide the inserted piece of cloth 7 from the front end of the cloth passage 3 to the conveying belt 62 and from the conveying belt 62 to the rear end of the cloth passage 3 continuously. Each cloth guide assembly 62 is comprised of two rollers 66, and a conveying belt 62 mounted around the rollers 66.

Figure 3:
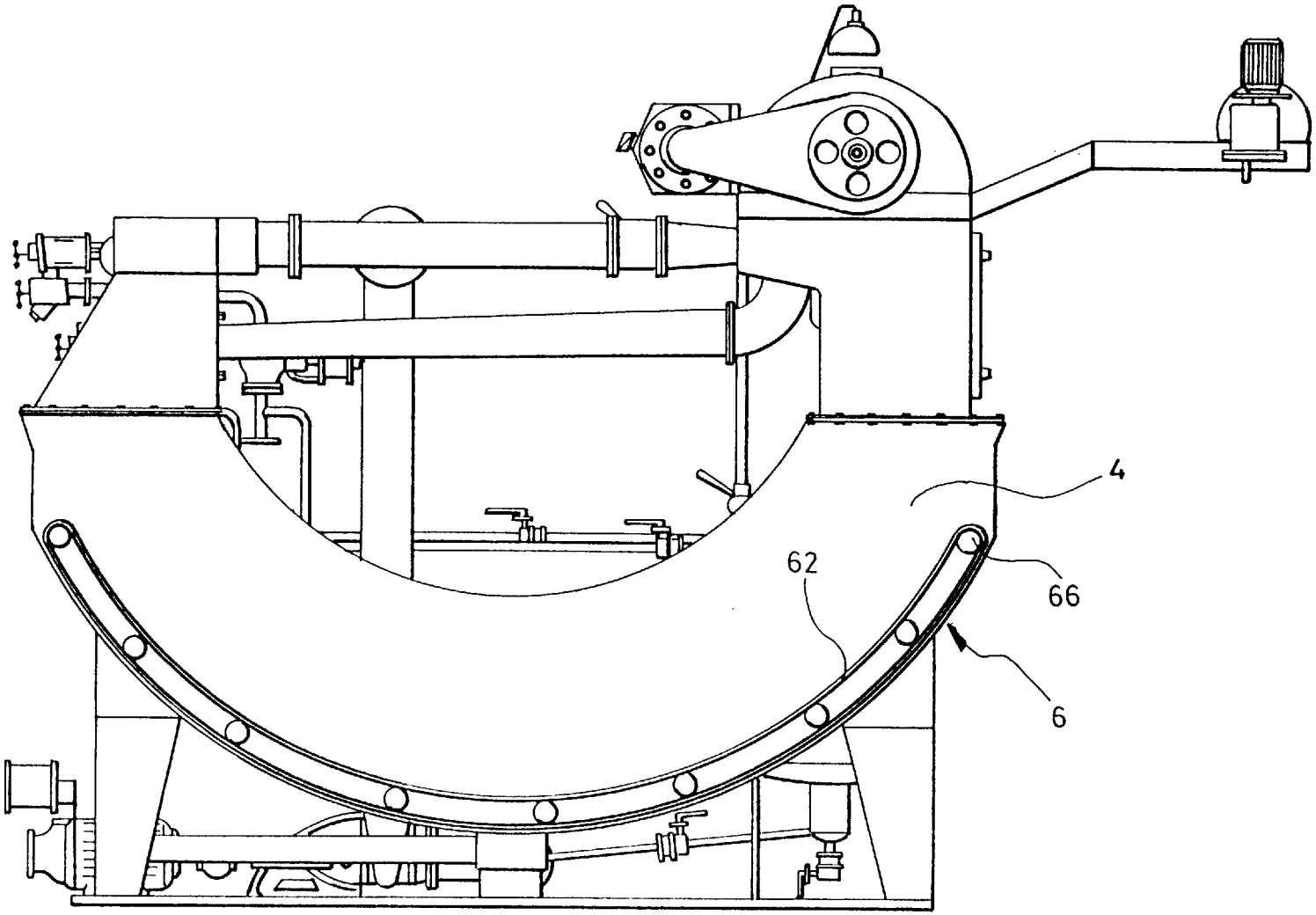
FIG. 3 is a front view in section of another alternate form of the present invention.

FIG. 3 shows another alternate form of the present invention, in which the receiving chamber, referenced by 4, has an arched configuration, and the rollers 61 of the cloth conveyer 6 are arranged alone the smoothly curved bottom wall of the receiving chamber 4.

It is to be understood that the drawings are designed for purposes of illustration only, and are not intended as a definition of the limits and scope of the invention disclosed.

What the invention claimed is:

1. A dyeing machine comprising a receiving chamber, a cloth passage disposed in combination with said receiving chamber through which a piece of cloth it inserted and dyed, a jet nozzle suspended above a front end of said cloth passage and controlled to spray a dyeing solution for dying the inserted piece of cloth, and a cloth guide roller suspended above said jet nozzle and turned to guide the inserted place of cloth from the front end of said cloth passage through said jet nozzle toward a rear end of said cloth passage, wherein a cloth conveying system is mounted within said receiving chamber at a bottom side and controlled to deliver the inserted piece of cloth through said cloth passage, said cloth conveying system comprising a set of main rollers arranged In parallel, a main conveying belt mounted on said main rollers and turned to deliver the inserted piece of cloth through said cloth passage, motor drive means controlled to turn said main rollers, first cloth guide means mounted inside said receiving chamber adjacent to one end of said main conveying belt and adapted for guiding the inserted piece of cloth from the front end of said cloth passage to said main conveying belt, second cloth guide means mounted inside said receiving chamber adjacent to an opposite end of said main conveying belt and adapted for guiding the inserted piece of cloth from said main conveying belt to the rear end of said cloth passage, said first cloth guide means and second cloth guide means being respectively comprised of a set of auxiliary rollers and and auxiliary conveying belt mounted on the respective set of auxiliary rollers.

2. A dyeing machine comprising a receiving chamber, a cloth passage disposed in combination with said receiving chamber through which a piece of cloth is inserted and dyed, a jet nozzle suspended above a front end of said sloth passage and controlled to spray a dyeing solution for dying the inserted piece of cloth, and a cloth guide roller suspended above said jet nozzle and turned to guide the inserted piece of cloth from the front end of said cloth passage through said jet nozzle toward a rear end of said cloth passage, wherein a cloth conveying system is mounted within said receiving chamber at a bottom side and controlled to deliver the inserted piece of cloth through said cloth passage, said cloth conveying system comprising a set of main rollers arranged in parallel, a main conveying belt mounted on said main rollers and turned to deliver the inserted piece of cloth through said cloth passage, motor drive means controlled to turn said main rollers, first cloth guide means mounted inside said receiving chamber adjacent to one end of said main conveying belt and adapted for guiding the inserted piece of cloth from the front end of said cloth passage to said main conveying belt, second cloth guide means mounted inside said receiving chamber adjacent to an opposite end of said main conveying belt and adapted for guiding the inserted piece of cloth from said main conveying belt to the rear end of said cloth passage, said first cloth guide means and said second cloth guide means being respectively and obliquely aimed at two opposite ends of said main conveying belt.

* * * * *